US007023390B1

(12) United States Patent
Kim et al.

(10) Patent No.: US 7,023,390 B1
(45) Date of Patent: Apr. 4, 2006

(54) RF ANTENNA ARRAY STRUCTURE

(75) Inventors: Kyung K. Kim, Colleyville, TX (US); William L. Stewart, II, Benbrook, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/890,556

(22) Filed: Jul. 12, 2004

(51) Int. Cl.
*H01Q 1/28* (2006.01)

(52) U.S. Cl. ..... 343/705; 343/700 MS

(58) Field of Classification Search ..... 343/705, 343/700 MS, 853, 824, 751
See application file for complete search history.

(56) References Cited

U.S. PATENT DOCUMENTS

| | | | | |
|---|---|---|---|---|
| 4,739,334 | A * | 4/1988 | Soref | 342/368 |
| 4,751,513 | A | 6/1988 | Daryoush et al. | 343/700 |
| 4,885,589 | A | 12/1989 | Edward et al. | 342/175 |
| 5,001,336 | A * | 3/1991 | de la Chapelle | 250/208.2 |
| 5,247,310 | A | 9/1993 | Waters | 342/368 |
| 5,751,248 | A * | 5/1998 | Thaniyavarn | 342/368 |
| 6,204,947 | B1 | 3/2001 | Page | 359/145 |
| 6,252,557 | B1 * | 6/2001 | Plugge et al. | 343/772 |
| 6,518,923 | B1 * | 2/2003 | Barquist et al. | 343/700 MS |
| 2003/0080899 | A1 | 5/2003 | Lee et al. | 342/368 |

FOREIGN PATENT DOCUMENTS

| | | |
|---|---|---|
| WO | WO 00/07307 | 2/2000 |

OTHER PUBLICATIONS

Akis Goutzoulis et al., "An Eight-Element, Optically Powered, Directly Modulated Receive UHF Fiber-Optic Manifold," XP000580225, *Microwave Journal*, Feb. 1996, 7 pages.

European Search Report in European Application No. 05254349.3 - 220 PCT/, dated Oct. 6, 2005, 6 pages.

* cited by examiner

*Primary Examiner*—Shih-Chao Chen
(74) *Attorney, Agent, or Firm*—Baker Botts L.L.P.

(57) ABSTRACT

According to one embodiment of the invention, an antenna system includes a substrate, a plurality of antennas formed on the substrate, a plurality of photodiodes formed on the substrate and coupled to respective ones of the antennas, and a plurality of optical fibers coupled to the substrate and coupled to respective ones of the photodiodes.

20 Claims, 2 Drawing Sheets

RF ANTENNA ARRAY STRUCTURE

TECHNICAL FIELD OF THE INVENTION

The present invention relates generally to the field of antennas and, more particularly, to a radio frequency (RF) antenna array structure.

BACKGROUND OF THE INVENTION

Antennas are used in many different applications. For example, they are very important in aircraft applications, especially military aircraft. Traditional RF antennas used in aircraft applications utilize copper coaxial cables to transmit RF signals. However, these copper coaxial cables are often heavy and bulky and, more notably, the RF transmitter signals suffer high transmission line loss in the cables between the power amplifiers and the antenna. Consequently, desired transmit signals need to be sufficient enough to compensate the losses during transmit process or use an RF amplifier near the antenna to regain the signal lost during the transmission over the coaxial cable.

SUMMARY OF THE INVENTION

According to one embodiment of the invention, an antenna system includes a substrate, a plurality of antennas formed on the substrate, a plurality of photodiodes formed on the substrate and coupled to respective ones of the antennas, and a plurality of optical fibers coupled to the substrate and coupled to respective ones of the photodiodes.

Embodiments of the invention provide a number of technical advantages. Embodiments of the invention may include all, some, or none of these advantages. In one embodiment, multi-layer fiber optic cables are constructed as part of an aircraft structure or an added structure to provide significant benefits in performance, installation, and cost for antennas. This approach may offer a flexible and reconfigurable architecture with embedded fiber optic networks in the skin or structure of platforms. Graceful degradation of system performance and multiple back-up networks are provided in some embodiments of the invention, along with a low observable platform, low transmission power operation, including low probability of intercept (LPI) and power management systems. Optical fibers have no electromagnetic interference susceptibility and emissivity. In one embodiment, an array of antennas may comprise a plurality of smaller arrays that are each adapted to operate within a different frequency band, thus offering system flexibility. For example, more than one beam positioning may be achieved via phase shifting. In one embodiment, an antenna array includes a multipin quick disconnect fiber optic connector for ease in installation and replacement.

Other technical advantages are readily apparent to one skilled in the art from the following figures, descriptions, and claims.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION

Figure 1:
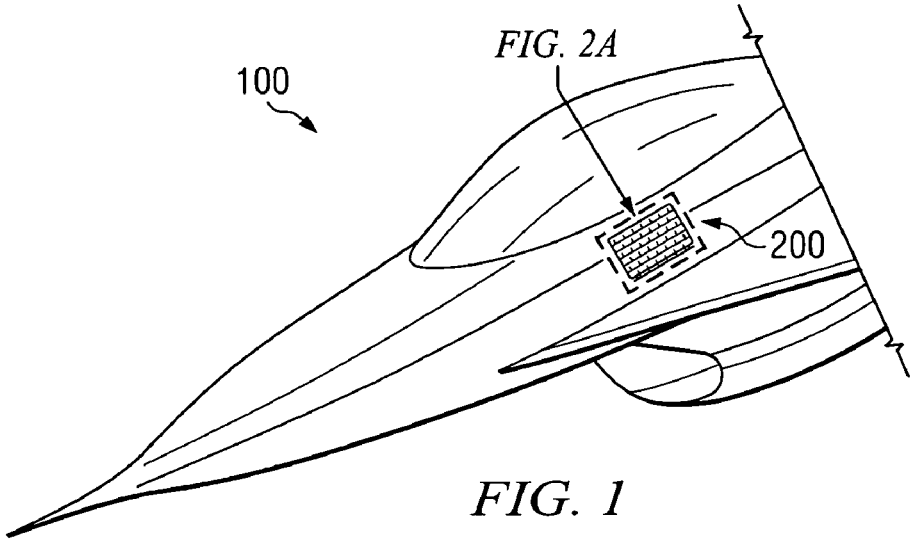
FIG. 1 is a perspective view of an aircraft incorporating an antenna array structure according to one embodiment of the invention.

FIG. 1 is a perspective view of an aircraft 100 incorporating an antenna system 200 according to one embodiment of the present invention. Although antenna system 200 is illustrated in FIG. 1 as being associated with aircraft 100, the present invention contemplates antenna system 200 being associated with other suitable vehicles, devices, and systems. In addition, although antenna system 200 is shown in the fuselage portion of aircraft 100, the present invention contemplates other suitable locations on aircraft 100 for antenna system 200. In the illustrated embodiment, antenna system 200 is a conformal antenna; however, antenna system 200 may be any suitable radio frequency (RF) antenna, such as a slotted array, a spiral, or other suitable antenna. Details of some embodiments of antenna system 200 are described below in conjunction with FIGS. 2A through 3.

Figure 2A:
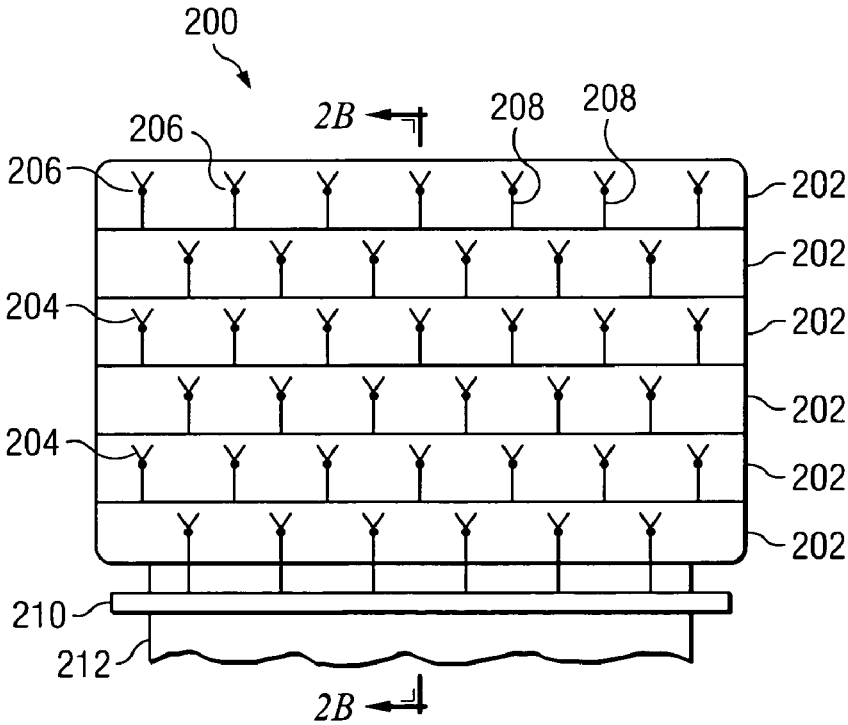
FIG. 2A is a top view of the antenna array structure of FIG. 1.
Figures 1, 2B:
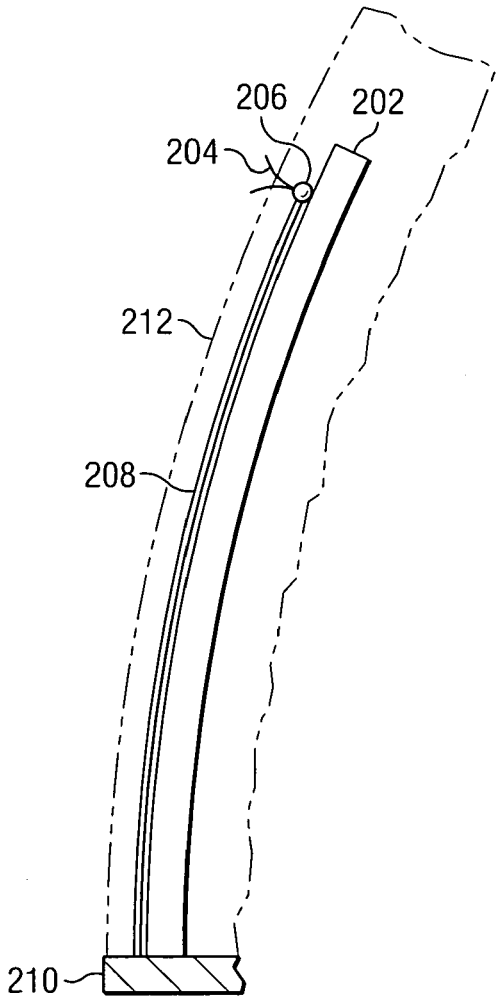
FIG. 2B is a cross-section of the antenna array structure of FIG. 1.
Figures 2, 2B:
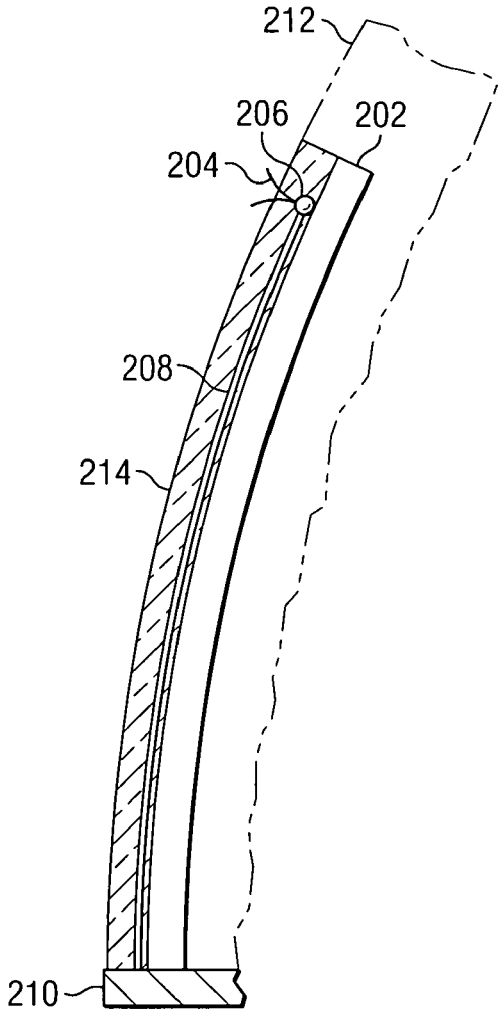

FIG. 2A is a top view of antenna system 200 according to one embodiment of the invention. In addition, FIGS. 2B-1 and 2B-2 illustrate two different cross-sections for antenna system 200 according to two different embodiments of the invention.

Referring to FIG. 2A, antenna system 200 includes a plurality of substrates 202 each having a plurality of antennas 204, a plurality of photodiodes 206, and a plurality of optical fibers 208. In addition, a connector 210 is illustrated in FIG. 2A as coupling optical fibers 208 to an additional set of optical fibers 212. Because of the relatively small size of antennas 204, photodiodes 206, and optical fibers 208 of antenna system 200, the embodiment illustrated in FIG. 2A is not to scale for purposes of clarity of description.

Substrates 202 are each illustrated in FIG. 2A as being generally rectangular in shape; however, substrates 202 may have any suitable shape depending on the application and type of antenna system 200. Substrates 202 may have any suitable thickness and may be formed from any suitable material, such as polyimide, composite material, or other suitable flexible circuit board or rigid circuit board material.

Antennas 204 are formed on substrate 202 using any suitable fabrication techniques, such as semiconductor fabrication techniques. Antennas 204 may have any suitable size and configuration and may be spaced apart any suitable distance depending on the desired operating frequency band or bands for antenna system 200. Antennas 204 may be formed from any suitable material, such as copper. Antennas 204 function to transmit radio frequency signals from antenna system 200.

Photodiodes 206, which are illustrated in FIGS. 2B-1 and 2B-2, are also formed on substrate 202 using any suitable fabrication techniques, such as suitable semiconductor fabrication techniques. Photodiodes 206 may also have any suitable size and configuration and may be formed from any suitable material, such as a suitably doped semiconductor material. Photodiodes 206 function to convert optical signals received from optical fibers 208 and convert them to electrical signals so that they may be transmitted by antennas 204.

Optical fibers 208 may be formed from any suitable optically transmissive material that transmits optical signals as guided waves of energy to photodiodes 206. Optical fibers 208 may be any suitable multi-mode waveguides or single mode waveguides having any suitable cross-section. Optical fibers 208 may couple to respective substrates 202 and extend from respective photodiodes 206 in any suitable manner. In order to facilitate easier installation and/or replacement of antenna system 200, connector 210 may be utilized. Connector 210 may be any suitable optical connector that couples optical fibers 208 to an additional set of optical fibers 212.

Thus, depending on the number and arrangement of antennas 204 and number and arrangement of substrates 202, antenna system 200 may comprise any suitable array of antennas 204. This array of antennas 204 may comprise a plurality of smaller arrays that are each adapted to operate within a different frequency band, thus offering flexibility of antenna system 200 along with graceful degradation of system performance and multiple backup networks. Utilizing optical fibers 208 in antenna system 200 avoids the losses associated with copper coaxial cables of previous antenna systems. In one embodiment, this eliminates the need to either amplify the signal power before transmitting the signal through the copper coaxial cable or amplifying the signal power at the antenna before transmission.

Because of the size of the components of antenna system 200 illustrated in FIG. 2A, substrate 202 may be flexible in nature so that it conforms to a contour of a particular surface, such as a fuselage of aircraft 100, for example. In addition, in some embodiments, substrates 202 are thin enough to enable antenna systems 200 to be either embedded within a skin 212 of aircraft 100 (see FIG. 2B-1) or be coupled to a surface of a skin 212 of aircraft 100 (see FIG. 2B-2).

Referring to FIG. 2B-1, a single substrate 202 is illustrated only for purposes of clarity of description. Substrate 202 is illustrated as being embedded within skin 212 and includes an optical fiber 208 extending from connector 210 to a photodiode 206 having an associated antenna 204. Referring to FIG. 2B-2, a substrate 202 is illustrated as being coupled to a surface of skin 212 and includes an optical fiber 208 extending from connector 210 to a photodiode 206 having an associated antenna 204. Because antenna system 200 is coupled on an outside surface of skin 212 in this embodiment, a radome 214 formed from any suitable radio frequency transparent material may be associated with antenna system 200 by coupling to substrate 202. Although antenna system 200 is illustrated as being embedded within skin 212 in FIG. 2B-1 and coupled to a surface of skin 212 as illustrated in FIG. 2B-2, other suitable locations for antenna system 200 are contemplated by the present invention.

Figure 3:
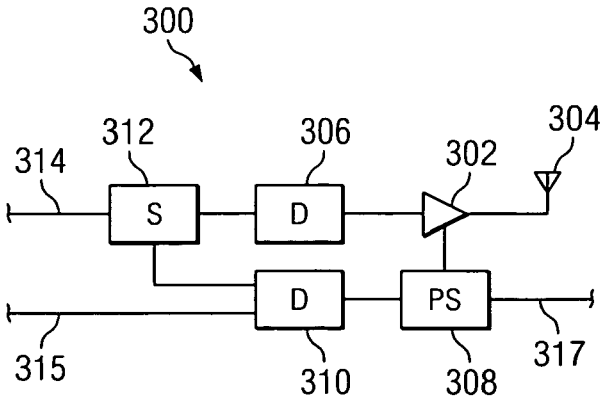
FIG. 3 is a partial schematic of an antenna array structure according to another embodiment of the present invention.

FIG. 3 is a partial schematic of an antenna system 300 according to another embodiment of the present invention. In this embodiment, a power amplifier 302 is formed on a substrate (not explicitly illustrated) and coupled between an antenna 304 and a photodiode 306. In order to power the power amplifier 302, a power supply 308 may be formed on the substrate in one embodiment. In this embodiment, power supply 308 couples to an additional photodiode 310 that couples to a splitter 312 associated with optical fiber 314.

In operation of the embodiment illustrated in FIG. 3, an optical signal traveling through optical fiber 314 is split by splitter 312 and delivered to photodiodes 306 and 310. The signal traveling to photodiode 310 is then converted to an electrical signal before being sent to power supply 308. Photodiode 306 also converts the optical signal to an electrical signal before sending it to power amplifier 302. Power supply 308 then provides power to power amplifier 302 so that the signal is amplified before being sent to antenna 304 for subsequent transmission.

In other embodiments of FIG. 3, a separate optical fiber 315 may be coupled to diode 310 for delivering photonics power to power supply 308, or aircraft electrical power or harvested power, as denoted by reference numeral 317, may be delivered to power supply 308. The harvested power may come from any suitable source, such as a vibrational source or a temperature source.

Although embodiments of the invention and their advantages are described in detail, a person skilled in the art could make various alterations, additions, and omissions without departing from the spirit and scope of the present invention as defined by the appended claims.

What is claimed is:

1. An antenna system, comprising:
a substrate;
a plurality of antennas formed on the substrate;
a plurality of photodiodes formed on the substrate and coupled to respective ones of the antennas; and
a plurality of optical fibers coupled to the substrate and coupled to respective ones of the photodiodes.

2. The system of claim 1, further comprising a connector coupled to the optical fibers, the connector adapted to couple to an additional set of optical fibers.

3. The system of claim 1, wherein the substrate is embedded within a composite material configured to form a skin of an aircraft.

4. The system of claim 1, wherein the substrate is coupled to a surface of a composite material configured to form a skin of an aircraft.

5. The system of claim 1, further comprising a radome coupled to the substrate.

6. The system of claim 1, further comprising a power amplifier formed on the substrate and coupled between the antenna and the photodiode of at least one of the coupled pairs of antennas and photodiodes.

7. The system of claim 6, further comprising a power supply coupled to the power amplifier and a splitter coupled to at least one of the optical fibers and operable to direct part of a signal traveling through the at least one optical fiber to the power supply.

8. A method of forming an antenna system, comprising:
providing a substrate;
forming a plurality of antennas on the substrate;
forming a plurality of photodiodes on the substrate and coupling the photodiodes to respective ones of the antennas; and
coupling a plurality of optical fibers to the substrate and coupling the optical fibers to respective ones of the photodiodes.

9. The method of claim 8, further comprising coupling a connector to the optical fibers, the connector adapted to couple to an additional set of optical fibers.

10. The method of claim 8, further comprising embedding the substrate within a composite material configured to form a skin of an aircraft.

11. The method of claim 8, further comprising coupling the substrate to a surface of a composite material configured to form a skin of an aircraft.

12. The method of claim 8, further comprising coupling a radome to the substrate.

13. The method of claim 8, further comprising forming a power amplifier on the substrate and coupling the power amplifier between the antenna and the photodiode of at least one of the coupled pairs of antennas and photodiodes.

14. The method of claim 13, further comprising coupling a power supply to the power amplifier and coupling a splitter to at least one of the optical fibers, the splitter operable to direct part of a signal traveling through the at least one optical fiber to the power supply.

15. An antenna system, comprising:

a plurality of substrates, each substrate comprising:

a plurality of antennas formed on the substrate;

a plurality of photodiodes formed on the substrate and coupled to respective ones of the antennas; and a plurality of optical fibers coupled to the substrate and coupled to respective ones of the photodiodes; and wherein the plurality of substrates are layered such that the antennas form an array.

16. The system of claim 15, further comprising a connector coupled to the optical fibers, the connector adapted to couple to an additional set of optical fibers.

17. The system of claim 15, wherein the plurality of substrates are embedded within a composite material configured to form a skin of an aircraft.

18. The system of claim 15, wherein the plurality of substrates are coupled to a surface of a composite material configured to form a skin of an aircraft.

19. The system of claim 15, further comprising a radome coupled to the plurality of substrates.

20. The system of claim 15, wherein the array comprises a plurality of smaller arrays each adapted to operate within a different frequency band.

* * * * *